US011778707B2

(12) United States Patent
Gadegaard

(10) Patent No.: US 11,778,707 B2
(45) Date of Patent: Oct. 3, 2023

(54) SETTINGS YIELDING DIFFERENT SPECTRA AND SIMILAR COLOR

(71) Applicant: Harman Professional Denmark ApS, Aarhus (DK)

(72) Inventor: Jesper Gadegaard, Tilst (DK)

(73) Assignee: HARMAN PROFESSIONAL DENMARK APS, Aarhus (DK)

( * ) Notice: Subject to any disclaimer, the term of this patent is extended or adjusted under 35 U.S.C. 154(b) by 266 days.

(21) Appl. No.: 17/206,941

(22) Filed: Mar. 19, 2021

(65) Prior Publication Data

US 2021/0360756 A1 Nov. 18, 2021

(30) Foreign Application Priority Data

May 13, 2020 (EP) ..... 20174380

(51) Int. Cl.

| | |
|---|---|
| ***H05B 45/22*** | (2020.01) |
| ***H05B 45/20*** | (2020.01) |
| ***H05B 47/155*** | (2020.01) |
| ***H05B 1/00*** | (2006.01) |
| ***H05B 31/00*** | (2006.01) |

(52) U.S. Cl.
CPC ..... *H05B 45/22* (2020.01)

(58) Field of Classification Search
CPC ..... H05B 45/20; H05B 45/22; H05B 47/155; H05B 1/00; H05B 3/00; H05B 31/00; H05B 33/00; H05B 35/00
See application file for complete search history.

(56) References Cited

U.S. PATENT DOCUMENTS 8,725,443 B2 * 5/2014 Uzelac ..... G06F 11/2221 702/79
8,988,087 B2 * 3/2015 Uzelac ..... G01R 31/2829 345/173
9,317,147 B2 * 4/2016 Welch ..... G06F 3/041
(Continued)

FOREIGN PATENT DOCUMENTS

WO 2010145658 A1 12/2010

OTHER PUBLICATIONS

European Patent Office, Extended European Search Report Issued in Application No. 20174380.4, dated Nov. 11, 2020, Germany, 8 pages.

*Primary Examiner* — Wei (Victor) Y Chan
(74) *Attorney, Agent, or Firm* — McCoy Russell LLP

(57) ABSTRACT

Disclosed herein are methods for controlling light fixtures comprising unique color light sources with independently controllable luminous flux, comprising controlling a luminous flux of each of the light sources, wherein a spectral distribution of light emitted from the light sources upon being controlled according to settings within a plurality of setting is different between settings, and a color of light emitted from the light sources is similar or identical between settings. The methods may improve color rendering where a certain color of emitted light is required, e.g., where a certain prop or costume is better illuminated with one setting compared to another setting, drawing attention to certain objects in a scene, e.g., by choosing a setting which makes a certain object stand out, and/or providing an intriguing optical effect, e.g., by shifting between settings, which makes certain objects appear to change color while others appear to keep same color.

20 Claims, 6 Drawing Sheets

(56) References Cited

U.S. PATENT DOCUMENTS

| | | | | |
|---|---|---|---|---|
| 9,378,389 | B2 * | 6/2016 | Kantor | H04L 63/102 |
| 10,201,056 | B1 | 2/2019 | Gordin et al. | |
| 11,521,482 | B2 * | 12/2022 | Neyhart | G08C 17/02 |
| 2012/0056911 | A1 * | 3/2012 | Safaee-Rad | G09G 3/2003 345/690 |
| 2013/0063042 | A1 * | 3/2013 | Bora | H05B 45/20 315/292 |
| 2016/0025304 | A1 * | 1/2016 | Wagemans | F21S 10/023 362/231 |
| 2018/0027637 | A1 | 1/2018 | Kurt et al. | |
| 2018/0106675 | A1 * | 4/2018 | Yao | G01J 1/4228 |

* cited by examiner

SETTINGS YIELDING DIFFERENT SPECTRA AND SIMILAR COLOR

CROSS REFERENCE TO RELATED APPLICATIONS

The present application claims priority to European Application No. 20174380.4, titled "SETTINGS YIELDING DIFFERENT SPECTRA AND SIMILAR COLOR," and filed on May 13, 2020. The entire contents of the above-listed application is hereby incorporated by reference for all purposes.

TECHNICAL FIELD

The present invention relates to a method for controlling a light fixture and more particularly relates to a method for controlling a light fixture according to a plurality of predefined settings varying the spectra of emitted light while maintaining the color of the emitted light, and furthermore relates to a corresponding control device, light fixture system and use thereof.

BACKGROUND

Light fixtures may be utilized for creating various light effects and/or mood lighting in connection with, e.g., concerts, live shows, TV shows, sport events or as architectural installation light fixtures creating various effects.

Besides the inherent capability of being able to emit light, it might be relevant to add one or more further functionalities to a light fixture, e.g., for the purpose of context (such as the specific scene and/or other light sources) specific optimization, such as improved color rendering, drawing attention to certain objects in a scene and/or providing an intriguing optical effect.

Hence, an improved method for controlling a light fixture enabling adding one or more further functionalities, for example for the purpose of scene specific optimization, such as improved color rendering, drawing attention to certain objects in a scene and/or providing an intriguing optical effect would be advantageous.

SUMMARY

Disclosed herein are methods and systems for controlling a light fixture and a corresponding control device, light fixture system and use thereof for enabling adding one or more further functionalities, for example for the purpose of scene specific optimization, such as improved color rendering, drawing attention to certain objects in a scene and/or providing an intriguing optical effect. Also disclosed herein are methods and systems for providing alternatives to the prior art.

Thus, the above described object and several other objects are intended to be obtained in various embodiments by providing a method for controlling a light fixture, wherein the light fixture comprises: a plurality of light sources comprising three or more light sources, wherein each of the light sources within the plurality of light sources has unique color, and wherein a luminous flux of each of the light sources is independently controllable, and wherein the method comprises: obtaining a plurality of settings where each setting within the plurality of settings is indicative of a luminous flux of each of the light sources within the plurality of light sources, and controlling a luminous flux of each of the light sources within the plurality of light sources according to one or more, such as two more, settings within the plurality of settings, wherein: a spectral distribution of light emitted from the plurality of light sources upon being controlled according to one setting within the plurality of setting is different with respect to a spectral distribution of light emitted from the plurality of light sources upon being controlled according to another setting within the plurality of settings, and a color of light emitted from the plurality of light sources upon being controlled according to one setting within the plurality of settings is similar or identical to a color of light emitted from the plurality of light sources upon being controlled according to another, such as the other (such as the one setting and the another setting being the same for the purpose of comparing spectral distribution of light and color of light), setting within the plurality of settings.

The methods and systems disclosed herein may be particularly, but not exclusively, advantageous for enabling adding one or more further functionalities to a light fixture, e.g., for the purpose of context (such as the specific scene and/or other light sources) specific optimization, such as improved color rendering (e.g., in case a certain color of emitted light is required, but a certain prop or costume is better illuminated with one setting compared to another setting), drawing attention to certain objects in a scene (e.g., by choosing a setting which makes a certain object stand out) and/or providing an intriguing optical effect (e.g., by shifting between settings, which makes certain objects appear to change color while others appear to keep same color).

By "light fixture" is understood an electrical device that contains an (electrical) light source, such as an illumination system with a light source, that provides illumination and wherein the light source and optionally one or more optical components is at least partially enclosed in a housing. The person skilled in (entertainment) light fixtures realizes that a number of light effects can be integrated into the light fixture. According to various embodiments, there is presented a light fixture with one or more of a prism for prism effects, an iris for iris effects, framing blades for framing effects, frost filter for frost effects, means for dimming effects, animation wheel for animation effects, one or more gobo wheels. The (entertainment) light fixture can be controlled based on an input signal indicative of light parameters which can be indicative of a target color indicating a decried color of the outgoing light, a number of light effect parameters indicative of a various numbers of light effects. The (entertainment) light fixture may comprise a processor configured to control the different light effects of the light fixture based on the light parameters received by the input signal. For instance the (entertainment) light fixture may comprise the light effects and be controlled based on various parameters as described in WO2010/145658 in particular on page 4 line 11-page 6 line 9.

"Light source" is understood as is common in the art, and may generally be an electric light source converting electrical power into luminous flux, such as a (plurality of) Light Emitting Diode (LED), such as a converted LED, such as a phosphor converted LED.

By "plurality of independently controllable light sources comprising three or more light sources, wherein each of the light sources within the plurality of light sources has a unique color, and wherein a luminous flux of each of the light sources is independently controllable," may be understood that there is at least three (such as 3 or more, such as 4 or more, such as 5 or more, such as 10 or more, such as 20 or more, such as 50 or more, such as 100 or more) light sources, each of which (three or more) light sources is having a unique color (such as unique with respect to colors of the other light sources) and wherein a luminous flux of each of the light sources is independently controllable. It is conceivable and encompassed that any one of said light sources itself comprises sub-"light sources" with identical or different colors, which combine to yield the color of the light source with independently controllable luminous flux. For example three independently controllable light sources having, respectively, colors red, green and blue, may comprise, respectively, 20 (identical) red, 30 (identical) green and 10 (identical) blue LEDs (sub-"light sources"). According to another example, three independently controllable light sources having, respectively, colors red, green and blue, may comprise, respectively, 20 different LEDs combining to form a red color, 30 different LEDs combining to form a green color and 10 different LEDs combining to form a blue color. However, in the context of the present application multiple sub-"light sources" combining to form one color (for which the luminous flux is independently controllable) is considered as one (combined) light source. Such (combined) light source of a certain color may comprise a plurality of sub-"light sources," which may be at least 2, such as at least 4, such as at least 5, such as at least 8, such as at least 10, such as at least 20, such as at least 40, such as at least 60, such as at least 80, such as at least 100, such as 120 or more. In case of the plurality of light sources with different colors comprise (only) three unique colors, it should be possible to substantially provide one of the colors as a combination of the others (such as the three colors being on a line in a color space, such as the CIE 1931 color space).

Color may be understood to be defined with reference to a chromaticity and chromaticity (coordinate) system, such as the CIE (Commission internationale de l"éclairage) 1931 color space.

By a "plurality of settings where each setting within the plurality of settings is indicative of a luminous flux of each of the light sources within the plurality of light sources" may be understood a plurality of sets or vectors each with a plurality of values indicative of a luminous flux of each of the light sources with a unique color.

By "luminous flux" is understood as is common in the art and represents a measure of perceived power of light.

By "light" is in the context of the present application generally understood visible electromagnetic radiation, such as electromagnetic radiation with wavelengths within (both endpoints included) 380-780 nm.

By "controlling a luminous flux of each of the light sources within the plurality of light sources according to one or more settings within the plurality of settings" may be understood driving each light source according to the corresponding value of the setting, e.g., applying a voltage across and/or an electrical current through a light source required to achieve a luminous flux according to a setting of a certain light source.

By "a spectral distribution of light emitted from the plurality of light sources upon being controlled according to one setting within the plurality of setting is different with respect to a spectral distribution of light emitted from the plurality of light sources upon being controlled according to another setting within the plurality of settings" may be understood that spectra according to different settings differ from each other. For different spectra, a ratio of intensity between at least two wavelengths within one spectrum is different (e.g., at least 10% larger than), with respect to the ratio of intensity between at least the same two wavelengths within the other spectrum.

Alternatively, a difference between spectra may be quantified as a distance between colors (e.g., as calculated by CIEDE2000) of reflection spectra resulting from light emitted from the plurality of light sources upon being controlled according to each of the plurality of settings being reflected from one or more reference samples. The reference samples may be the reference samples in the Color Quality Scale method. One or more reference samples may be selected based on their color point (e.g. as calculated using a D65 light source) to have references samples that are spread across the color space. The difference can be calculated using a subset of the references samples, e.g. a number of reference samples that are nearest to the target color.

By "a color of light emitted from the plurality of light sources upon being controlled according to one setting within the plurality of setting is similar or identical to a color of light emitted from the plurality of light sources upon being controlled according to another setting within the plurality of settings" may be understood that the color of light emitted according to different settings may be similar or identical to each other, meaning that the color points are close to or identical to each other in a color space.

A distance (including a zero distance) between colors may be calculated by CIEDE2000, cf., ISO/CIE 11664-6:2014, Colorimetry—Part 6: CIEDE2000 Color-difference formula. Two colors may be considered similar or identical to each other if E.g., delta E equal to or less than 20, such as equal to or less than 10, such as equal to or less than 5, such as equal to or less than 2, such as equal to or less than 1, such as equal to 0.

According to some embodiments, there is presented a method wherein the plurality of light sources comprises four or more, such as five or more, light sources, such as wherein said four or more light sources comprises at least three light sources where none of the three light sources has a color which can be provided as a linear combination of the two other light sources within the three light sources. More light sources enable more variety. Spanning a larger part of the color space enables covering a larger gamut of colors.

By "gamut" is understood a subset of (all) colors which can be accurately represented in a given circumstance, such as within a given color space, such as a color space spanned by a convex hull of color points of the plurality of light sources comprising three or more light sources, wherein each of the light sources within the plurality of light sources has unique color.

According to some embodiments, there is presented a method wherein controlling a luminous flux of each of the light sources within the plurality of light sources according to a first predefined setting and/or a second setting, comprises: switching (such as switching instantly or near-instantly or making a smooth or gradual transition, e.g., where a gradual transition implies that one or more settings between two end-point settings are applied during a switching from one end-point setting to another end-point setting) one or more times, such as multiple times, such as multiple times at a frequency of equal to or more than 0.1 Hz or 1 Hz or 10 Hz, between controlling the luminous flux of each of the light sources within the plurality of light sources according to different settings within the plurality of settings.

Switching may be advantageous, e.g., for providing mesmerizing effects and/or for catching the attention of observers, e.g., by choosing the settings so that a certain object stands out in one setting but not the one other setting, and then switching between the settings to make the object appear to repeatedly flash.

According to further embodiments, there is presented a method wherein switching is carried out multiple times, such as back and forth between the same predefined settings, and with a period (which can be predefined or variable) between consecutive steps of switching being equal to or less than 10 seconds, such as equal to or less than 1 second, such as equal to or less than 0.1 second. An effect of such relatively fast switching may be that the effect is less likely to be perceived as (quasi-)stationary.

According to some embodiments, there is presented a method wherein the method comprises controlling a luminous flux of each of the light sources within the plurality of light sources according to at least a first setting and a second setting for which the difference in spectral distribution of light emitted from the plurality of light sources upon being controlled according to the first setting and the second setting is as large as possible for the color. An advantage of this may be that maximum spectral difference for a given color is provided.

According to further embodiments, there is presented a method wherein a luminous flux of light emitted from the plurality of light sources upon being controlled according to the first setting is identical or similar to a luminous flux of light emitted from the plurality of light sources upon being controlled according to the second setting. A possible advantage may be that a constant luminous flux is provided when changing between settings, such as so that while the spectra change, the luminous flux remains the same.

According to some embodiments, there is presented a method wherein the method furthermore comprises controlling a luminous flux of each of the light sources within the plurality of light sources according to at least a third setting for which spectral distribution of light emitted from the plurality of light sources upon being controlled according to the third setting is similar or identical to a spectral distribution of light emitted from the plurality of light sources upon being controlled according to the first setting, and a fourth setting for which spectral distribution of light emitted from the plurality of light sources upon being controlled according to the fourth setting is similar or identical to a spectral distribution of light emitted from the plurality of light sources upon being controlled according to the second setting, and wherein a luminous flux of light emitted from the plurality of light sources upon being controlled according to the third setting is identical or similar to a luminous flux of light emitted from the plurality of light sources upon being controlled according to the fourth setting, and wherein a luminous flux of light emitted from the plurality of light sources upon being controlled according to the third setting and/or the fourth setting is different with respect to a luminous flux of light emitted from the plurality of light sources upon being controlled according to the first setting and/or the second setting.

A possible advantage of such embodiments may be that they enable changing the spectra but keeping luminous flux constant (e.g., when changing between first and second setting or between third and fourth setting) and changing luminous flux but keeping spectra constant (e.g., when changing between first and third setting or between second and fourth setting).

According to various embodiments, there is presented a method, wherein a difference between spectral distribution of light emitted from the plurality of light sources according to two different settings is quantified by: identify a set of reference samples in the color space, such as reference samples of the Color Quality Scale, identify a reference light source, such as CIE Standard Illuminant D65, select between employing a single reference sample or a plurality of reference samples, in case only a single reference sample is selected, e.g., in case the color of light emitted from the plurality of light sources upon being controlled according to the two different settings is similar or identical to a color of a reference sample when illuminated by the reference light source, optionally identify a reference sample which have a color when illuminated by the reference light source, which is similar or identical to the color of light emitted from the plurality of light sources upon being controlled according to the two different settings, provide, such as calculate, two reflection spectra based on reflection from said reference sample of light emitted from the plurality of light sources according to the two different settings, calculate colors of the two reflection spectra, quantify the difference between spectral distribution of light emitted from the plurality of light sources according to the two different settings as the distance, such as CIEDE2000 distance, between the colors of the two reflection spectra, in case a plurality of reference samples is selected, e.g., in case the color of light emitted from the plurality of light sources upon being controlled according to the two different settings is not similar or identical to a color of a reference sample when illuminated by the reference light source, optionally identify a plurality, such as 2 or 3 or 4 or 5 or 6 or more, of reference samples which have colors when illuminated by the reference light source, such as reference samples which are nearest (such as quantified with CIEDE2000) to the color of light emitted from the plurality of light sources upon being controlled according to the two different settings, provide, such as calculate, for each reference sample within the plurality of reference samples, two reflection spectra based on reflection from said reference sample of light emitted from the plurality of light sources according to the two different settings, calculate colors of the provided reflection spectra (which may be a number of reflection spectra given by the number of the plurality of reference samples multiplied by 2 due to the two different settings), quantify the difference between spectral distribution of light emitted from the plurality of light sources according to the two different settings as a distance (such as an average or weighted average distance), such as CIEDE2000 distance, between the colors of the reflection spectra for the two reflection spectra for each reference sample.

An advantage of such methods may be that they enable quantifying spectral difference. It is noted that a spectral difference according to this quantification may be interpreted as the ability of two different spectra (even having the same color) to make a reference sample appear to have different colors. In some embodiments, the reference samples may be the references samples of the Color Quality Scale, the reference light source may be as CIE Standard Illuminant D65 and color distance may be quantified as the CIEDE2000 distance, the reference sample having a color when illuminated with the reference light source which is closest to the light ht emitted from the plurality of light sources upon being controlled according to the two different settings is chosen for the quantification. By different colors may be understood a calculated CIEDE2000 distance of at least 1, such as at least 2, such as least 5, such as at least 7, such as at least 10, such as at least 20.

According to some embodiments, there is presented a method wherein each setting within the plurality of settings each corresponds to a basis setting or a superposition of a plurality of basis settings, wherein each basis setting is indicative of a luminous flux of each light source within a strict subset of light sources, such as two or three light sources, within the plurality of light sources. According to such embodiments, there may be identified multiple strict subsets of light sources where each of these subsets is representative of a solution to providing the (desired) color and each setting is given either purely as a subset or as a combination of subsets.

According to further embodiments, there is presented a method wherein any one of the following options apply: each setting in the plurality of settings is similar or identical to a basis setting, at least a first setting within the plurality of settings is similar or identical to a basis setting and wherein the remaining settings are arranged so that a luminous flux of light emitted from the plurality of light sources upon being controlled according to the first setting is identical or similar to a luminous flux of light emitted from the plurality of light sources upon being controlled according to any one of the remaining settings, at least a second setting within the plurality of settings is similar or identical to a basis setting and wherein at least a third setting is similar or identical to a basis setting and wherein the second basis setting and the third basis setting are arranged so that a luminous flux of light emitted from the plurality of light sources upon being controlled according to the second setting is identical or similar to a luminous flux of light emitted from the plurality of light sources upon being controlled according to the third basis setting, the plurality of settings are arranged so that a luminous flux of light emitted from the plurality of light sources upon being controlled according to any setting is identical or similar to a reference luminous flux value, the plurality of settings are arranged so as to each differ from any one basis setting and optionally wherein the plurality of settings are arranged so that a luminous flux of light emitted from the plurality of light sources upon being controlled according to any setting is identical or similar to a reference luminous flux value.

Note in general that numerical adjectives "first," "second," "third" and "fourth" merely goes to enable distinguishing between element (e.g., settings) and do not imply a certain sequence or presence of other numerical adjectives (e.g., a "second element" do not necessarily imply presence of a "first element").

According to various embodiments, there is presented a control device for controlling: a plurality of light sources comprising three or more light sources, wherein each of the light sources within the plurality of light sources has a unique color, and wherein a luminous flux of each of the light sources is independently controllable, wherein the control device is arranged for optionally comprising or obtaining a plurality of settings where each setting within the plurality of settings is indicative of a luminous flux of each of the light sources within the plurality of light sources, and controlling a luminous flux of each of the light sources within the plurality of light sources according to one or more settings within a plurality of settings, wherein: a spectral distribution of light emitted from the plurality of light sources upon being controlled according to one setting within the plurality of setting is different with respect to a spectral distribution of light emitted from the plurality of light sources upon being controlled according to another setting within the plurality of settings, and a color of light emitted from the plurality of light sources upon being controlled according to one setting within the plurality of setting is similar or identical to a color of light emitted from the plurality of light sources upon being controlled according to another setting within the plurality of settings.

According to various embodiments, there is presented a light fixture system comprising: a light fixture comprising a plurality of light sources comprising three or more light sources, wherein each of the light sources within the plurality of light sources has a unique color, and wherein a luminous flux of each of the light sources is independently controllable, a control device as disclosed herein.

According to some embodiments, there is presented a light fixture system being adapted for carrying out methods disclosed herein.

According to some embodiments, there is presented a light fixture system, wherein the light fixture system is further comprising: a storage unit, wherein the storage unit is operationally connected to the control device and comprising information corresponding to the plurality of settings.

According to some embodiments, there is presented use of control devices as disclosed herein and/or light fixture systems as disclosed herein for emitting light according to one or more settings within the plurality of settings, such as for carrying out a method as disclosed herein.

BRIEF DESCRIPTION OF THE DRAWINGS

Various embodiments will now be described in more detail with regard to the accompanying figures. The figures show one way of implementing the embodiments and are not to be construed as being limiting to other possible embodiments falling within the scope of the attached claim set.

DETAILED DESCRIPTION

Figure 1:
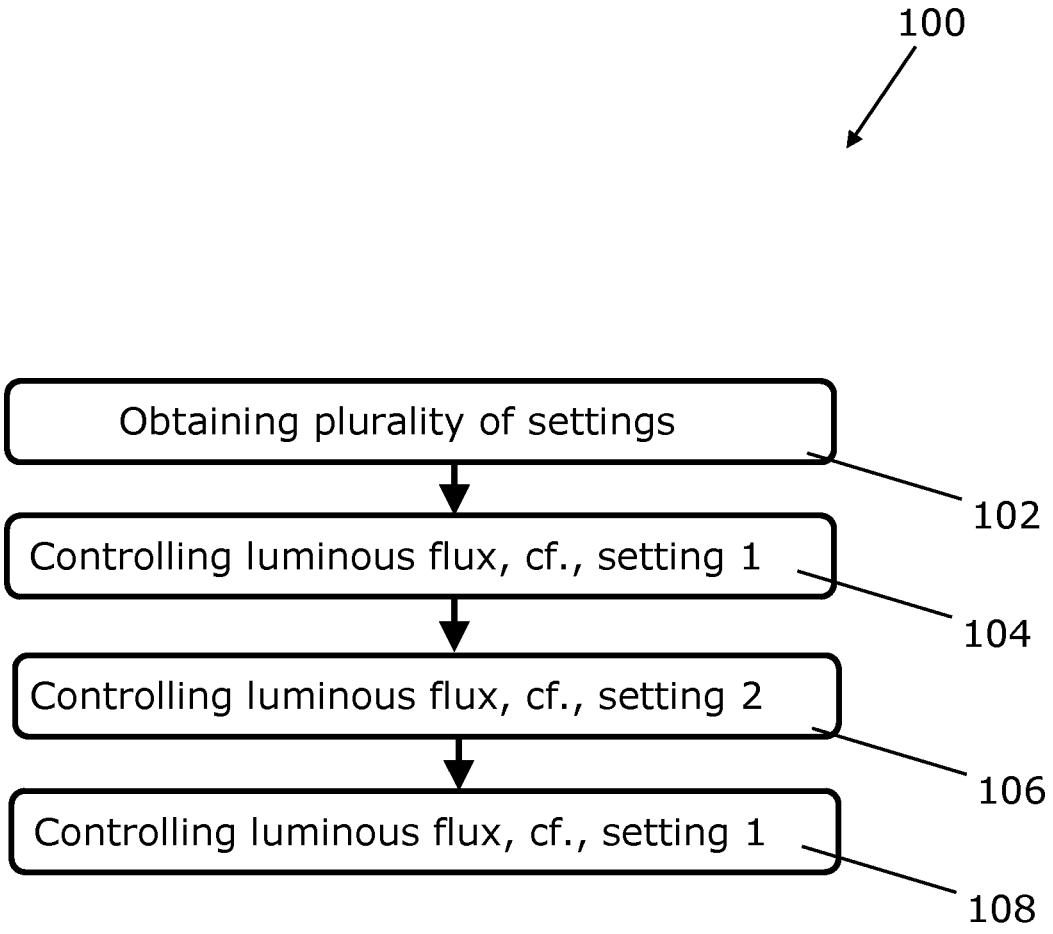
FIG. 1 shows a flow-chart of a method, in accordance with some embodiments of the disclosure.

FIG. 1 shows a flow-chart of a method 100 for controlling a light fixture, wherein the light fixture comprises: a plurality of light sources comprising three or more light sources, wherein each of the light sources within the plurality of light sources has a unique color, wherein a luminous flux of each of the light sources is independently controllable, and wherein the method comprises: obtaining 102 a plurality of settings where each setting within the plurality of settings is indicative of a luminous flux of each of the light sources within the plurality of light sources, and controlling 104 a luminous flux of each of the light sources within the plurality of light sources according to one or more settings within the plurality of settings, which in the present figure is "setting 1," wherein: a spectral distribution of light emitted from the plurality of light sources upon being controlled according to one setting (such as "setting 1") within the plurality of setting is different with respect to a spectral distribution of light emitted from the plurality of light sources upon being controlled according to another setting (such as "setting 2") within the plurality of settings, and a color of light emitted from the plurality of light sources upon being controlled according to one setting (such as "setting 1") within the plurality of settings is similar or identical to a color of light emitted from the plurality of light sources upon being controlled according to another setting (such as "setting 2") within the plurality of settings.

The flow-chart furthermore shows additional, subsequent steps of: controlling 106 a luminous flux of each of the light sources within the plurality of light sources according to another setting, which in the present figure is "setting 2" which is different from "setting 1," within the plurality of settings, and subsequently controlling 108 a luminous flux of each of the light sources within the plurality of light sources according to another setting, which in the present figure is "setting 1" which is different from "setting 1," within the plurality of settings, The flow-chart thus depicts controlling a luminous flux of each of the light sources within the plurality of light sources according to a first setting and/or a second setting, which comprises switching multiple times between controlling the luminous flux of each of the light sources within the plurality of light sources according to different settings within the plurality of settings.

Figure 2:
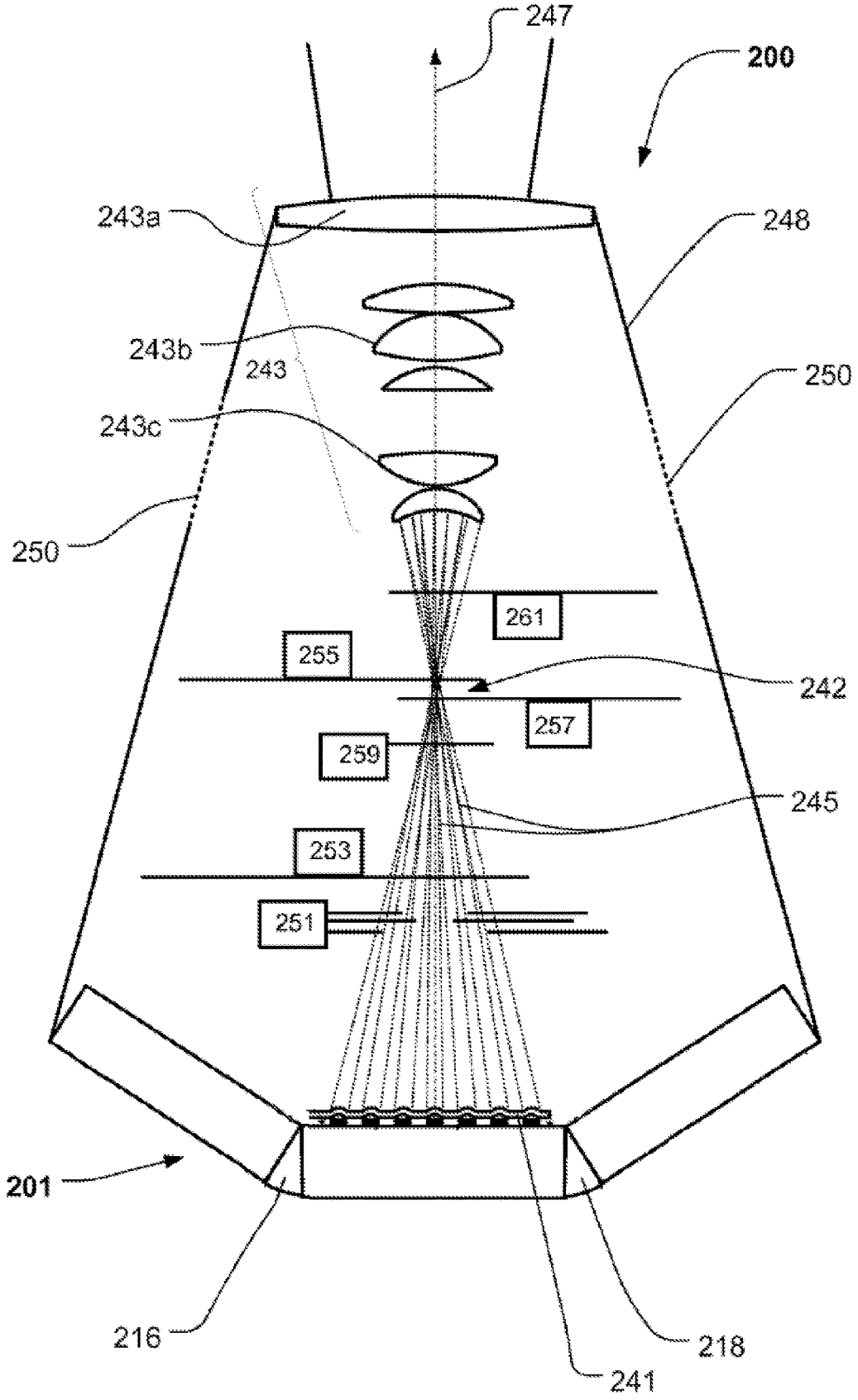
FIG. 2 illustrates a structural diagram of an illumination device, in accordance with some embodiments of the disclosure.

FIG. 2 illustrates a structural diagram of an illumination device 200 (wherein "illumination device" and "light fixture" may be understood interchangeably throughout the present application). The illumination device comprises a cooling module 201 comprising a plurality of LEDs 103 (which may in various embodiments be other light sources), a light collector 241, an optical gate 242 and an optical projecting and zoom system 243. The cooling module is arranged in the bottom part of a lamp housing 248 of the illumination device and the other components are arranged inside the lamp housing 248. The lamp housing 248 can be provided with a number of openings 250. The light collector 241 is adapted to collect light from the LEDs 103 and to convert the collected light into a plurality of light beams 245 (dotted lines) propagating along an optical axis 247 (dash-dotted line). The light collector can be embodied as any optical means capable of collecting at least a part of the light emitted by the LEDs and convert the collected light to a light beams. In the illustrated embodiment the light collector comprises a number of lenslets each collecting light from one of the LEDs and converting the light into a corresponding light beam. However it is noticed that the light collector also can be embodied a single optical lens, a Fresnel lens, a number of TIR lenses (total reflection lenses), a number of light rods or combinations thereof. It is understood that light beams propagating along the optical axis contain rays of light propagating at an angle, e.g. an angle less than 45 degrees to the optical axis. The light collector may be configured to fill the optical gate 242 with light from the LEDs 103 so that the area, i.e. the aperture, of the gate 242 is illuminated with a uniform intensity or optimized for max output. The gate 242 is arranged along the optical axis 247. The optical projecting system 243 may be configured to collect at least a part of the light beams transmitted through the gate 242 and to image the optical gate at a distance along the optical axis. For example, the optical projecting system 243 may be configured to image the gate 242 onto some object such as a screen, e.g. a screen on a concert stage. A certain image, e.g. some opaque pattern provided on a transparent window, an open pattern in a non-transparent material, or imaging object such as GOBOs known in the field of entertainment lighting, may be contained within the gate 242 so that that the illuminated image can be imaged by the optical projecting system. Accordingly, the illumination device 200 may be used for entertainment lighting. In the illustrated embodiment the light is directed along the optical axis 247 by the light collector 241 and passes through a number of light effects before exiting the illumination device through a front lens 243*a*. The light effects can for instance be any light effects known in the art of intelligent/entertainments lighting for instance, a CMY subtractive color mixing system 251, color filters 253, gobos 255, animation effects 257, iris effects 259, a focus lens group 243*c*, zoom lens group 243*b*, prism effect 261, framing effects (not shown), or any other light effects known in the art. The mentioned light effects only serves to illustrate the principles of an illuminating device for entertainment lighting and the person skilled in the art of entertainment lighting will be able to construct other variations with additional are less light effects. Further it is noticed that the order and positions of the light effects can be changed.

Figure 3:
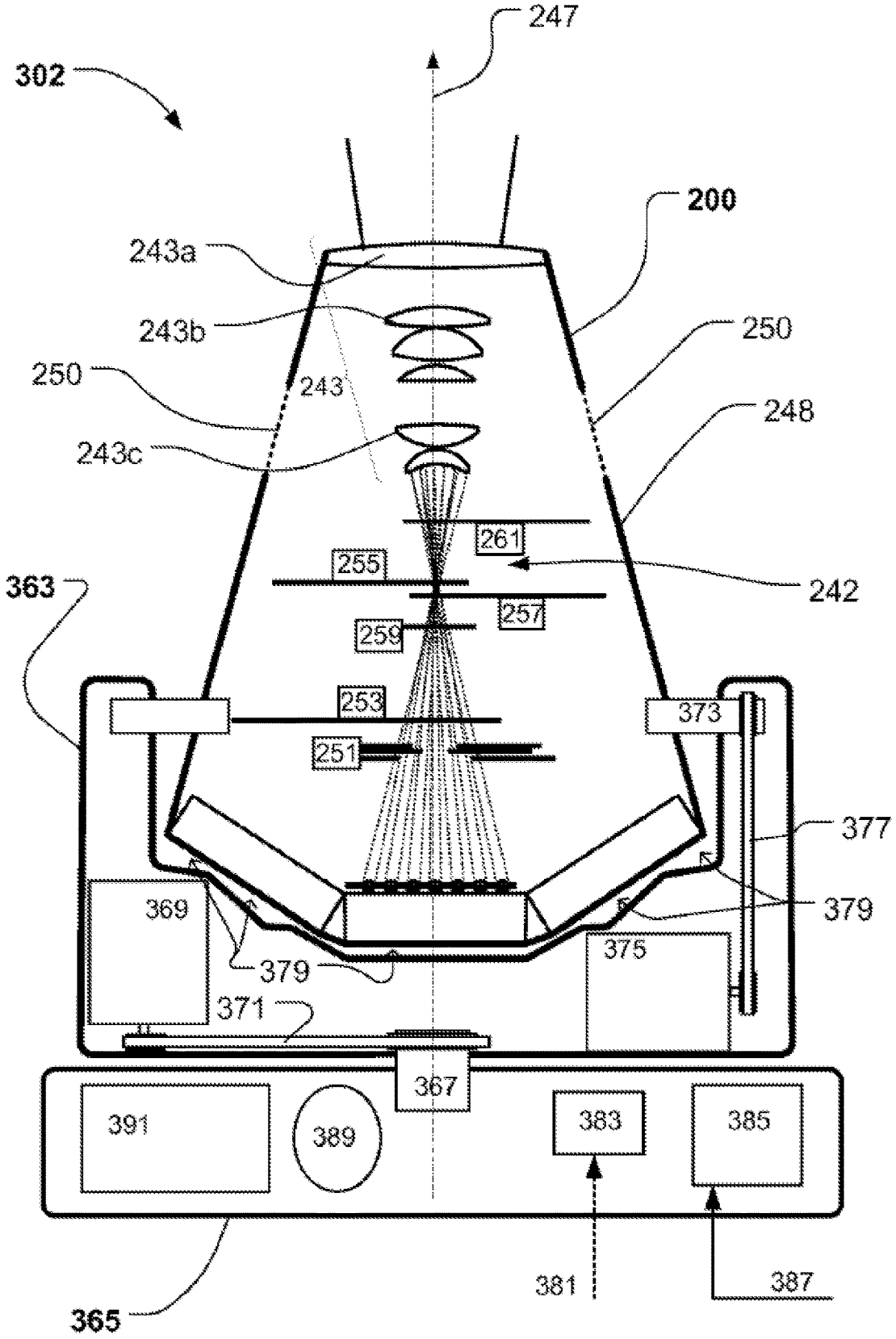
FIG. 3 illustrates a structural diagram of a moving head light fixture, in accordance with some embodiments of the disclosure.

FIG. 3 illustrates a structural diagram of a moving head light fixture 302 comprising a head 200 rotatable connected to a yoke 363 where the yoke is rotatable connected to a base 365. The head is substantially identical to the illumination device shown in FIG. 2 and substantial identical features are labeled with the same reference numbers as in FIG. 2 and will not be described further. The moving head light fixture comprises pan rotating means for rotating the yoke in relation to the base, for instance by rotating a pan shaft 367 connected to the yoke and arranged in a bearing (not shown) in the base). A pan motor 369 is connected to the shaft 367 through a pan belt 371 and is configured to rotate the shaft and yoke in relation to the base through the pan belt. The moving head light fixture comprises tilt rotating means for rotating the head in relation to the yoke, for instance by rotating a tilt shaft 373 connected to the head and arranged in a bearing (not shown) in the yoke). A tilt motor 375 is connected to the tilt shaft 373 through a tilt belt 377 and is configured to rotate the shaft and head in relation to the yoke through the tilt belt. The skilled person will realize that the pan and tilt rotation means can be constructed in many different ways using mechanical components such as motors, shafts, gears, cables, chains, transmission systems, bearings etc. Alternatively it is noticed that it also is possible to arrange the pan motor in the base and/or arrange the tilt motor in the head. A space 379 between the yoke and the bottom part of the head is limited as the moving head light fixture is designed to be as small as possible. As known in the prior art the moving head light fixture receives electrical power 381 from an external power supply (not shown). The electrical power is received by an internal power supply 383 which adapts and distributes electrical power through internal power lines (not shown) to the subsystems of the moving head. The internal power system can be constructed in many different ways for instance by connecting all subsystems to the same power line. The skilled person will however realize that some of the subsystems in the moving head need different kind of power and that a ground line also can be used. The light source will for instance in most applications need a different kind of power than step motors and driver circuits. The light fixture comprises also a controller 385 (where "controller" throughout the present text is used interchangeably with "control device") which controls the components (other subsystems) in the light fixture based on an input signal 387 indicative light effect parameters, position parameters and other parameters related to the moving head lighting fixture. The controller receives the input signal from a light controller (not shown) as known in the art of intelligent and entertainment lighting for instance by using a standard protocol like DMX, ArtNET, RDM etc. Typically the light effect parameter is indicative of at least one light effect parameter related to the different light effects in the light system. The controller 385 is adapted to send commands and instructions to the different subsystems of the moving head through internal communication lines (not shown). The internal communication system can be based on a various type of communications networks/systems. The moving head can also comprise user input means enabling a user to interact directly with the moving head instead of using a light controller to communicate with the moving head. The user input means 389 can for instance be bottoms, joysticks, touch pads, keyboard, mouse etc. The user input means can also be supported by a display 391 enabling the user to interact with the moving head through a menu system shown on the display using the user input means. The display device and user input means can in some embodiments also be integrated as a touch screen.

Figure 4:
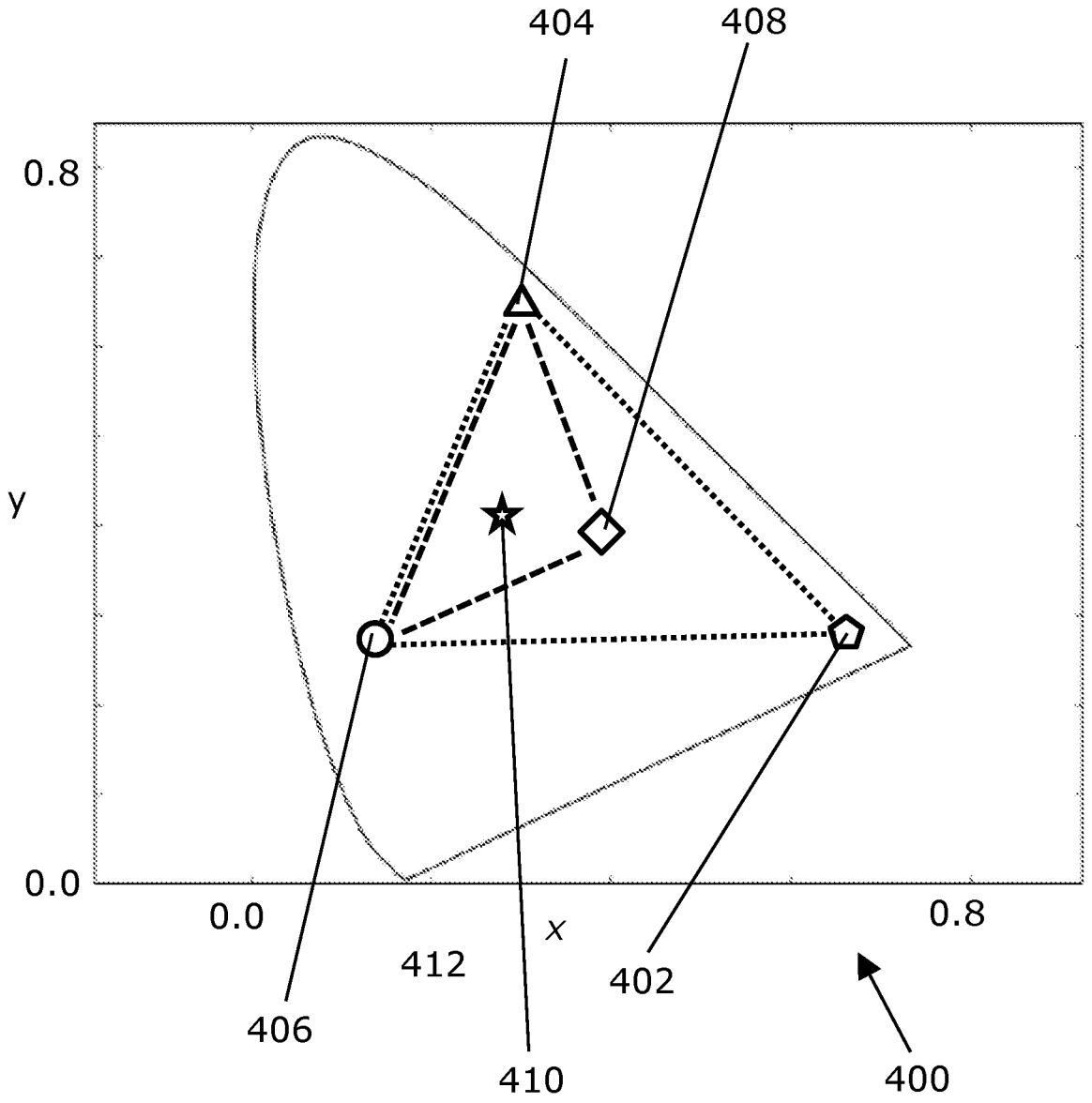
FIG. 4 shows a CIE 1931 color space 400 with coordinates of four light sources, in accordance with some embodiments of the disclosure.

FIG. 4 shows a CIE 1931 color space 400 with coordinates of four light sources, wherein each of the light sources within the four light sources has a unique color, wherein a luminous flux of each of the light sources is independently controllable. The four unique colors are red (as indicated by pentagon 402), green (as indicated by triangle 404), blue (as indicated by circle 406) and white (as indicated by diamond 408), where the white light source may have a substantially continuous spectrum. Coordinates of a desired color are indicated with star 410. The four light sources comprises two sets of light sources for which a convex hull encompasses the coordinates of the desired color. The gamut of all color points that a light fixture with a plurality of independently controllable, differently colored light sources can generate is encompassed by the convex hull of all the color points of these light sources. The desired color point can be generated by a combinations of all combinations of, e.g., three light sources which encompasses the target point. For example, the desired color can be produced as a combination of the red, green and blue light sources, as indicated by the larger triangle with dotted sides. As another example, the desired color can be produced as a combination of the white, green and blue light sources, as indicated by the smaller triangle with dashed sides. While the desired color can thus be produced in two different ways, the resulting spectra will not be identical (for example, in the first instance, the spectrum may comprise red, green and blue peaks while in the second instance the spectrum may be substantially continuous and have blue and green peaks).

A color of a light source may be described by tristimulus levels X, Y, Z, according to CIE 1931 color matching functions where Y is the luminous flux, and a scalar control value d which is a value in the range [0; 1] where 1 means that a light source is fully on and 0 for fully off. A resulting color $R_{abc}$ of a superposition of three light sources denoted "a," "b," "c" (with RGB color levels of light source "a" being $X_a$, $Y_a$, $Z_a$, and luminous flux da and anologosly for light sources "b" and "c") may be given as a matrix product (with matrices being indicated with two lines above a symbol and vectors indicated with one arrow above a symbol):

$$\vec{R}_{abc} = \begin{bmatrix} X_a & X_b & X_c \\ Y_a & Y_b & Y_c \\ Z_a & Z_b & Z_c \end{bmatrix} \cdot \begin{bmatrix} d_a \\ d_b \\ d_c \end{bmatrix} = \overline{\overline{C}}_{abc} \cdot \vec{d}_{abc}$$

By inverting the 3×3 matrix $\overline{\overline{C}}_{abc}$ a solution $\vec{d}_{abc}$ for the luminous flux settings of a set of three light sources "a," "b" and "c" for the resulting color $\vec{R}_{abc}$ may be provided as:

$$\vec{d}_{abc} = \overline{\overline{C}}_{abc}^{-1} \cdot \vec{R}_{abc}$$

Note that it might be necessary to scale the resulting vector $\vec{d}_{abc}$ so that for i=a, b, c, $\max(d_i)=1$, where it is understood that luminous flux is normalized so as to be controllable from 0 to (maximum) 1. The coordinates in a color space (x, y) may be provided from these coordinates.

Thus, a method for identifying a plurality of settings may comprise (a) find all M triangles that contains desired color point (x, y), (b) identify settings for the light sources of each triangle (e.g., by inverting a matrix and scaling as outlined above) and (c) weight the M solutions according to a selected preference.

Figure 5:
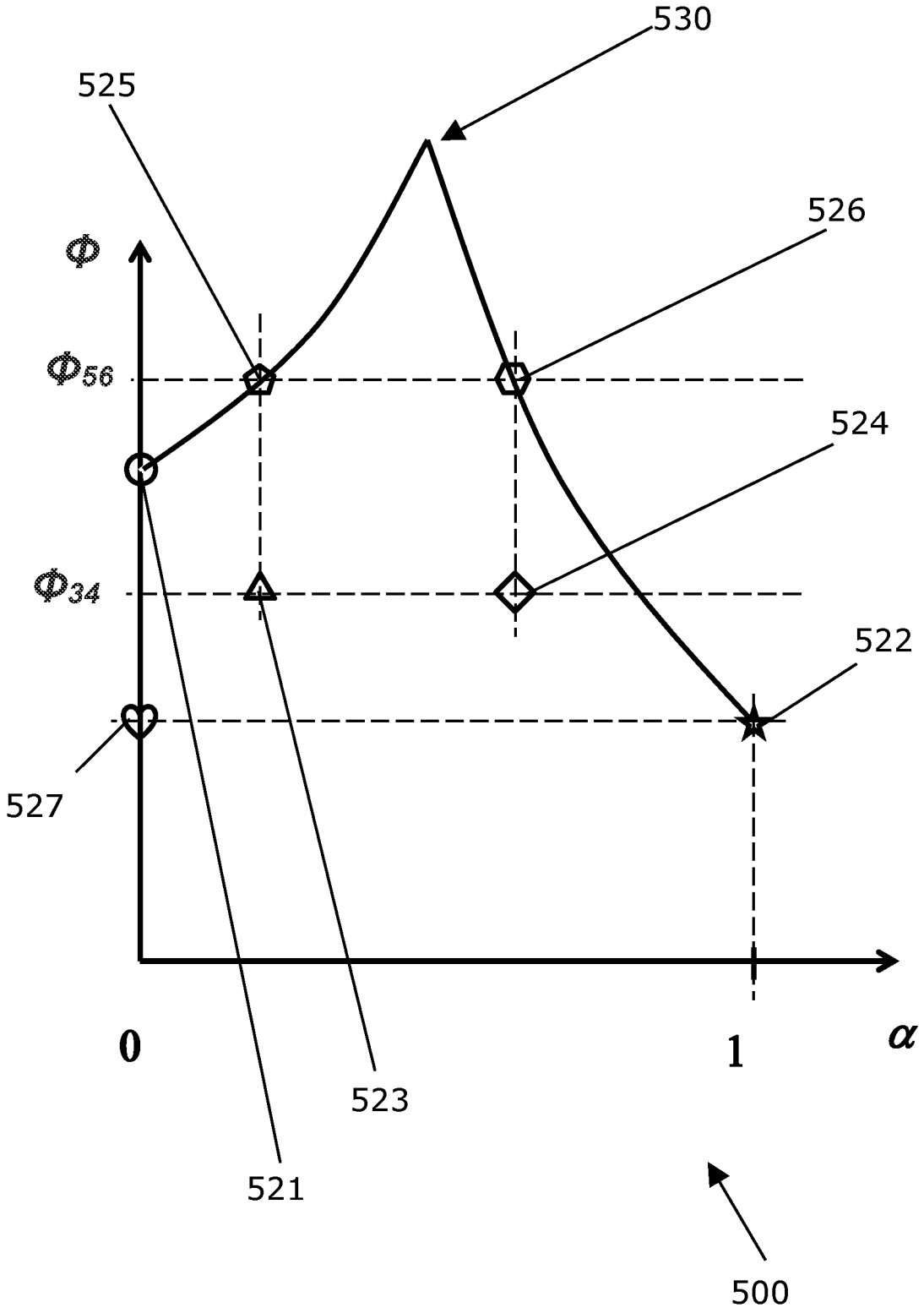
FIG. 5 shows a graph 500 with possible selected preferences for weighting to achieve two or more settings, in accordance with some embodiments of the disclosure.

FIG. 5 shows a graph 500 with possible selected preferences for weighting to achieve two or more settings. In the example of FIG. 5, there are two possible solutions (such as triangles, cf., e.g., the situation of FIG. 4. The figure shows on the x-axis a variable a with values between 0 and 1 (both endpoints 0 and 1 included) and indicative of a contribution from each solution, such as the combination varying from being made up of exclusively one solution at $\alpha=0$, gradually increasing the contribution from the other solution until the combination is made op exclusively of the other solution at $\alpha=1$ (such as the weighting in the combination D of the first solution S1 and the second solution S2 being $D=(1-\alpha)S1+\alpha S2$)). The solution must be scaled such that all elements of D are in the range [0; 1]. The curve of the graph indicates the maximum luminous flux of the respective combinations of the two solutions. The top point of the curve, where the two sections meet in the top point 530, is the point of maximum lumen output, could in general be chosen according to a objective to maximize lumen output. However, according to some embodiments, alternative weightings may be applied with an objective to provide multiple settings with similar or identical colors and different spectra. The more light we allow to loose, the higher the spectral difference we can achieve. It is conceivable and encompassed though, that in some embodiments, one setting corresponds to the weighting for which maximum lumen output may be achieved.

According to some embodiments, the two settings (combinations of solutions) are chosen so that the difference in spectral distribution of light emitted from the plurality of light sources upon being controlled according to the first setting and the second setting is as large as possible and the luminous flux for each combination is as large as possible, such as the combinations being represented by the circle 521 and the star 522.

According to alternative embodiments, the two settings (combinations of solutions) are chosen so that the difference in spectral distribution of light emitted from the plurality of light sources upon being controlled according to the first setting and the second setting is as large as possible and wherein a luminous flux of light emitted from the plurality of light sources upon being controlled according to the first setting is identical or similar to a luminous flux of light emitted from the plurality of light sources upon being controlled according to the second setting, such as the combinations being represented by the heart 527 and the star 522.

Note that each of the above solutions involving the circle 521, star 522 and heart 527 correspond to a basis setting wherein each basis setting is indicative of a luminous flux of each light source within a strict subset of light sources (with each strict subset being one of the triangles, with the remaining light source not contributing) within the plurality of light sources.

However, it is also conceivable and encompassed that a solution is a superposition of a plurality of basis settings. For example in case of controlling a luminous flux of each of the light sources within the plurality of light sources according to at least a fifth setting, cf., pentagon 525, and a sixth setting, cf., hexagon 526, for which the difference in spectral distribution of light emitted from the plurality of light sources upon being controlled according to the first setting and the second setting is as large as possible for a given luminous flux $\theta_{56}$, a third setting, cf., triangle 523, for which spectral distribution of light emitted from the plurality of light sources upon being controlled according to the third setting is similar or identical to a spectral distribution of light emitted from the plurality of light sources upon being controlled according to the fifth setting, and a fourth setting, cf., diamond 524, for which spectral distribution of light emitted from the plurality of light sources upon being controlled according to the fourth setting is similar or identical to a spectral distribution of light emitted from the plurality of light sources upon being controlled according to the sixth setting, and wherein a luminous flux $\theta_{34}$ of light emitted from the plurality of light sources upon being controlled according to the third setting is identical or similar to a luminous flux $\theta_{34}$ of light emitted from the plurality of light sources upon being controlled according to the fourth setting, and wherein a luminous flux $\theta_{34}$ of light emitted from the plurality of light sources upon being controlled according to the third setting and/or the fourth setting is different with respect to a luminous flux $\theta_{56}$ of light emitted from the plurality of light sources upon being controlled according to the fifth setting and/or the sixth setting.

Figure 6:
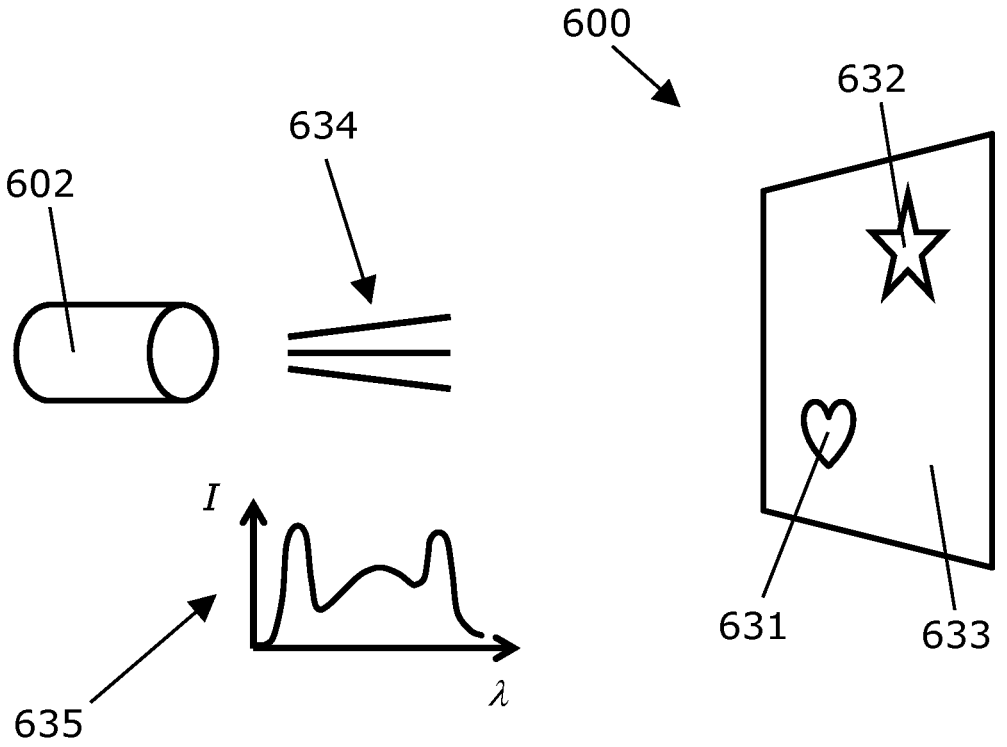
FIGS. 6-7 show an illustration of an embodiment in the context of illumination of a scene, in accordance with some embodiments of the disclosure.
Figure 7:
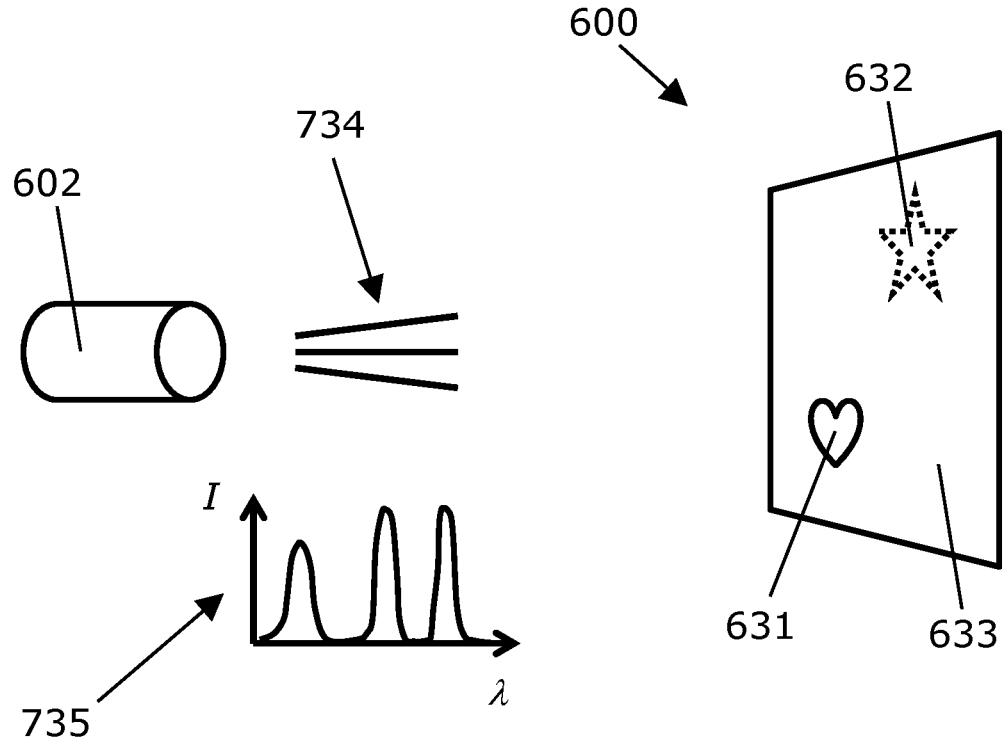

FIGS. 6-7 show an illustration of an embodiment in the context of illumination of a scene.

FIG. 6 shows a moving head 602 emitting light 634 according to a first setting, which light illuminates a scene 600, comprising a background 633, a first object being a heart 631 and a second object being a star 632. The light 634 according to the first setting has a first spectral distribution as indicated by spectrum 635, which makes both the first object being a heart 631 and the second object being a star 632 clearly visible to an observer, such as a person in an audience in a theatre.

FIG. 7 shows the same moving head 602 as in FIG. 6 emitting light 734 according to a second setting, which light illuminates the same scene 600 as in FIG. 6, comprising the same background 633, the same first object being a heart 631 and the same second object being a star 632. The light 734 according to the first setting has a second spectral distribution as indicated by spectrum 735, which makes only the first object being a heart 631 clearly visible to an observer, whereas the second object being a star 632 is not clearly visible to an observer, such as pale (as indicated by the dotted line forming the star 632 in FIG. 6), such as a person in an audience in a theatre. This could for example be utilized to make the star appear to be blinking by repeatedly switching abruptly between the first and second settings and/or to be sparkling by repeatedly changing gradually between the first and second settings. The light 734 emitted according to the second setting has the same color as the light 634 emitted according to the first setting. Thus, in case the background is formed by a white material, there might be little or no difference as observed by an observer between illumination of the background 633 according to the first or the second setting, e.g., in case the luminous flux according to the first and second setting were identical.

There is presented a method 100 for controlling a light fixture 200 comprising unique color light sources with independently controllable luminous flux, wherein the method comprises controlling 104 a luminous flux of each of the light sources, wherein a spectral distribution of light emitted from the plurality of light sources upon being controlled according to settings within a plurality of setting is different between settings, and a color of light emitted from the plurality of light sources is similar or identical between settings. The methods and systems disclosed herein may be advantageous for improved color rendering in case a certain color of emitted light is required, e.g., where a certain prop or costume is better illuminated with one setting compared to another setting, drawing attention to certain objects in a scene, e.g., by choosing a setting which makes a certain object stand out, and/or providing an intriguing optical effect, e.g., by shifting between settings, which makes certain objects appear to change color while others appear to keep same color.

Although the present invention has been described in connection with the specified embodiments, it should not be construed as being in any way limited to the presented examples. The scope of the present invention is set out by the accompanying claim set. In the context of the claims, the terms "comprising" or "comprises" do not exclude other possible elements or steps. Also, the mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

The invention claimed is:

1. A method for controlling a light fixture, wherein the light fixture comprises a plurality of light sources including three or more light sources, wherein each of the light sources has a unique color, and wherein a luminous flux of each of the light sources is independently controllable, the method comprising:

obtaining a plurality of settings, each of the settings being indicative of a luminous flux of each of the light sources; and controlling a luminous flux of each of the light sources according to one or more of the settings, wherein a spectral distribution of light emitted from the plurality of light sources upon being controlled according to one setting within the plurality of settings is different with respect to a spectral distribution of light emitted from the plurality of light sources upon being controlled according to another setting within the plurality of settings;

wherein a color of light emitted from the plurality of light sources upon being controlled according to one setting within the plurality of settings is identical to a color of light emitted from the plurality of light sources upon being controlled according to another setting within the plurality of settings; and wherein each setting within the plurality of settings corresponds to a superposition of a plurality of basis settings, wherein each basis setting is indicative of a luminous flux of each light source within a different strict subset of light sources of the plurality of light sources.

2. The method of claim 1, wherein the plurality of light sources comprises four or more light sources; and wherein the four or more light sources comprise at least three light sources for which none of the three light sources has a color which can be provided as a linear combination of the two other light sources of the three light sources.

3. The method of claim 1, wherein the controlling of the luminous flux of each of the light sources comprises switching one or more times between controlling the luminous flux of each of the light sources according to different settings within the plurality of settings.

4. The method of claim 3, wherein the switching between controlling the luminous flux of each of the light sources according to the different settings is at a predetermined frequency that is greater than or equal a frequency selected from a group consisting of: 0.1 hertz (Hz), 1 Hz, and 10 Hz.

5. The method of claim 3, wherein the switching is carried out multiple times, back and forth between the same settings, and is at a predetermined period that is less than or equal to a period selected from a group consisting of: 10 seconds; 1 second; and 0.1 second.

6. The method of claim 1, wherein the controlling of the luminous flux of each of the light sources is according to at least a first setting and a second setting for which the difference in spectral distribution of light emitted from the plurality of light sources upon being controlled according to the first setting and the second setting is maximized for the color.

7. The method of claim 6, wherein a luminous flux of light emitted from the plurality of light sources upon being controlled according to the first setting is similar to a luminous flux of light emitted from the plurality of light sources upon being controlled according to the second setting.

8. The method of claim 7, wherein the controlling of the luminous flux of each of the light sources is according to at least:

a third setting for which a spectral distribution of light emitted from the plurality of light sources upon being controlled according to the third setting is similar to a spectral distribution of light emitted from the plurality of light sources upon being controlled according to the first setting; and a fourth setting for which a spectral distribution of light emitted from the plurality of light sources upon being controlled according to the fourth setting is similar to a spectral distribution of light emitted from the plurality of light sources upon being controlled according to the second setting, wherein a luminous flux of light emitted from the plurality of light sources upon being controlled according to the third setting is identical or similar to a luminous flux of light emitted from the plurality of light sources upon being controlled according to the fourth setting; and wherein a luminous flux of light emitted from the plurality of light sources upon wherein a luminous flux of light emitted from the plurality of light sources upon being controlled according to one or more of the third setting and the fourth setting is different with respect to a luminous flux of light emitted from the plurality of light sources upon being controlled according to one or more of the first setting and the second setting.

9. The method of claim 1, further comprising:

quantifying a difference between spectral distributions of light emitted from the plurality of light sources according to two different settings by identifying a set of reference samples, identifying a reference light source, and selecting between employing a single reference sample or a plurality of reference samples;

wherein, when the single reference sample is selected, the method further comprises:

calculating two reflection spectra based on reflection from said reference sample of light emitted from the plurality of light sources according to the two different settings;

calculating colors of the two reflection spectra; and quantifying the difference between spectral distribution of light emitted from the plurality of light sources according to the two different settings as the distance between the colors of the two reflection spectra, and wherein, when the plurality of reference samples is selected, the method further comprises:

calculating for each reference sample within the plurality of reference samples, two reflection spectra based on reflection from said reference sample of light emitted from the plurality of light sources according to the two different settings, calculating colors of the provided reflection spectra, quantifying the difference between spectral distribution of light emitted from the plurality of light sources according to the two different settings as an average or weighted-average distance between the colors of the reflection spectra for the two reflection spectra for each reference sample.

10. The method of claim 9, wherein the identified set of reference samples comprises reference samples of the Color Quality Scale;

wherein the identified reference light source is CIE Standard Illuminant D65; and wherein the average or weighted-average distance between the colors of the reflection spectra for the two reflection spectra is an average or weighted-average CIEDE2000 distance.

11. The method of claim 9, wherein the selection between employing the single reference sample or the plurality of reference samples is based upon whether a color of light emitted from the plurality of light sources upon being controlled according to the two different settings is not similar to a color of a reference sample when illuminated by the reference light source.

12. The method of claim 1, wherein each setting within the plurality of settings corresponds to a setting selected from a group consisting of: a basis setting, and the superposition of the plurality of basis settings.

13. The method of claim 12, wherein each setting in the plurality of settings is similar to a basis setting.

14. The method of claim 12, wherein at least a first setting within the plurality of settings is similar to a basis setting, and wherein the remaining settings are arranged so that a luminous flux of light emitted from the plurality of light sources upon being controlled according to the first setting is identical or similar to a luminous flux of light emitted from the plurality of light sources upon being controlled according to any one of the remaining settings.

15. The method of claim 14, wherein at least a second setting within the plurality of settings is similar to a basis setting, and wherein at least a third setting is similar to a basis setting, and wherein the second basis setting and the third basis setting are arranged so that a luminous flux of light emitted from the plurality of light sources upon being controlled according to the second setting is identical or similar to a luminous flux of light emitted from the plurality of light sources upon being controlled according to the third basis setting.

16. The method of claim 12, wherein the plurality of settings are arranged so that a luminous flux of light emitted from the plurality of light sources upon being controlled according to any setting is identical or similar to a reference luminous flux value.

17. The method of claim 12, wherein the plurality of settings are arranged so as to each differ from any one basis setting, and wherein the plurality of settings are arranged so that a luminous flux of light emitted from the plurality of light sources upon being controlled according to any setting is identical or similar to a reference luminous flux value.

18. A control device for controlling a plurality of light sources comprising three or more light sources, wherein each of the light sources within the plurality of light sources has a unique color;

wherein a luminous flux of each of the light sources is independently controllable;

wherein the control device is operable to control a luminous flux of each of the light sources according to one or more settings within a plurality of settings;

wherein a spectral distribution of light emitted from the plurality of light sources upon being controlled according to one setting within the plurality of settings is different with respect to a spectral distribution of light emitted from the plurality of light sources upon being controlled according to another setting within the plurality of settings;

wherein a color of light emitted from the plurality of light sources upon being controlled according to one setting within the plurality of settings is similar to a color of light emitted from the plurality of light sources upon being controlled according to another setting within the plurality of settings; and wherein each setting within the plurality of settings corresponds to a superposition of a plurality of basis settings, wherein each basis setting is indicative of the luminous flux of each light source within a different strict subset of light sources of the plurality of light sources.

19. A light fixture system comprising:

the control device of claim 18; and a light fixture comprising a plurality of light sources including three or more light sources, wherein each of the light sources within the plurality of light sources has a unique color, and wherein a luminous flux of each of the light sources is independently controllable.

20. A light fixture system according to claim 19, further comprising:

a storage unit operationally connected to the control device and comprising information corresponding to the plurality of settings.

* * * * *